US006247754B1

(12) United States Patent
Vanderaue et al.

(10) Patent No.: US 6,247,754 B1
(45) Date of Patent: Jun. 19, 2001

(54) TAKE APART CHAIR

(75) Inventors: Daniel A. Vanderaue, West Bloomfield; Roman J. Rabiej, Mattawan, both of MI (US); Dmitry Azrikan, Chicago, IL (US)

(73) Assignee: The Board of Trustees of Western Michigan University, Kalamazoo, MI (US)

( * ) Notice: Subject to any disclaimer, the term of this patent is extended or adjusted under 35 U.S.C. 154(b) by 0 days.

(21) Appl. No.: 09/500,564

(22) Filed: Feb. 9, 2000

Related U.S. Application Data

(63) Continuation of application No. 29/100,871, filed on Feb. 19, 1999.

(51) Int. Cl.[7] ..... A47C 7/00

(52) U.S. Cl. ..... 297/440.13; 297/448.1; 297/446.1

(58) Field of Search ..... 297/440.1, 440.13, 297/440.15, 440.22, 448.1, 445.1, 446.2, 447.1, 449.1, 446.1

(56) References Cited

U.S. PATENT DOCUMENTS

| | | | |
|---|---|---|---|
| D. 134,806 | | 1/1943 | Brown et al. . |
| D. 365,938 | | 1/1996 | Gilborn et al. . |
| 2,444,991 | * | 7/1948 | Hunter . |
| 3,262,405 | | 7/1966 | Sutton . |
| 3,847,435 | | 11/1974 | Skinner . |
| 4,712,837 | * | 12/1987 | Swilley . |
| 5,605,378 | | 2/1997 | Oyediran . |
| 5,992,938 | * | 11/1999 | Jones . |

* cited by examiner

*Primary Examiner*—Milton Nelson, Jr.
(74) *Attorney, Agent, or Firm*—Flynn, Thiel, Boutell & Tanis, P.C.

(57) ABSTRACT

A chair (20) formed out of two side panels (22, 24) and a seat panel (26). The side panels are formed with complementary slots (32, 34) that allow the side panels to be interlocked. The seat panel is formed to have wings (44) that extend out from the sides of the seat panel adjacent the front of the seat panel. The wings seat in slots (48) that extend rearwardly from the front ends of the side panels. The seat panel is also formed with tabs (52) that extend out from the side edges of the panel. The tabs rest on support surfaces (54, 55) formed on the side panels. The assembly of this chair does not require the use of any fastening tools.

16 Claims, 7 Drawing Sheets

TAKE APART CHAIR

RELATIONSHIP TO EARLIER FIELD APPLICATION

This application is a continuation of U.S. Design application Ser. No. 29/100,871, filed Feb. 19, 1999.

FIELD OF THE INVENTION

This application relates generally to furniture that can readily be disassembled.

BACKGROUND OF THE INVENTION

It is known to provide furniture that can be disassembled. Often the pieces forming this type of furniture are held together with fasteners such as bolts or ropes. A disadvantage of this type of furniture is that the person assembling it must have access to tools in order to secure the fasteners and the pieces of the furniture together. Also, often, some degree of manual dexterity may be required in order to assembly the furniture. These dual requirements of tools and dexterity may inhibit some individuals from purchasing and using furniture that can be readily assembled and disassembled.

SUMMARY OF THE INVENTION

This invention relates to a chair that can be disassembled. The chair of this invention is formed out of three panels that are assemble together without the aid of supplemental fasteners.

DETAILED DESCRIPTION

Figure 1:
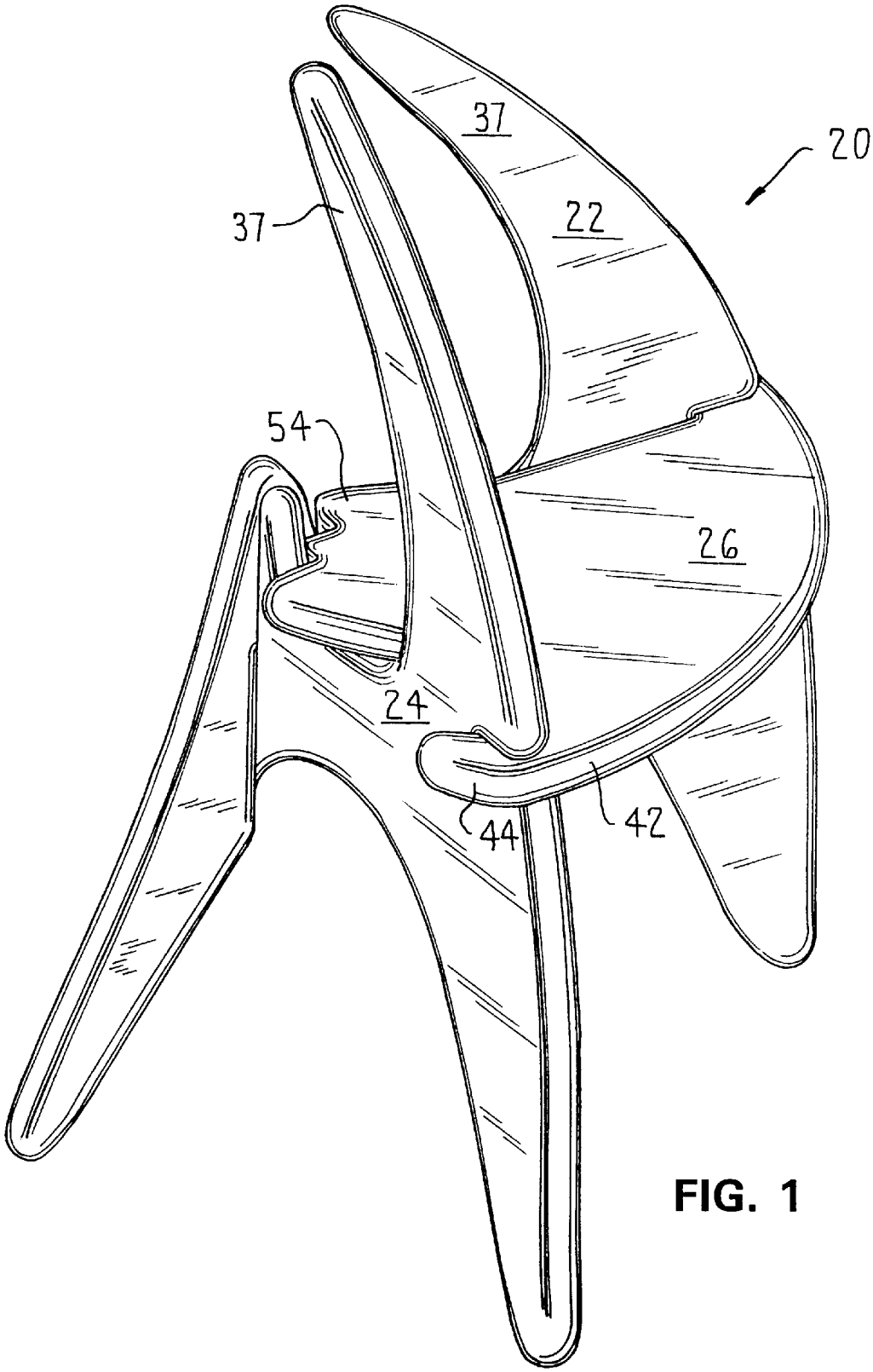
FIG. 1 is a perspective front view of the TAKE APART CHAIR of our design.
Figure 2:
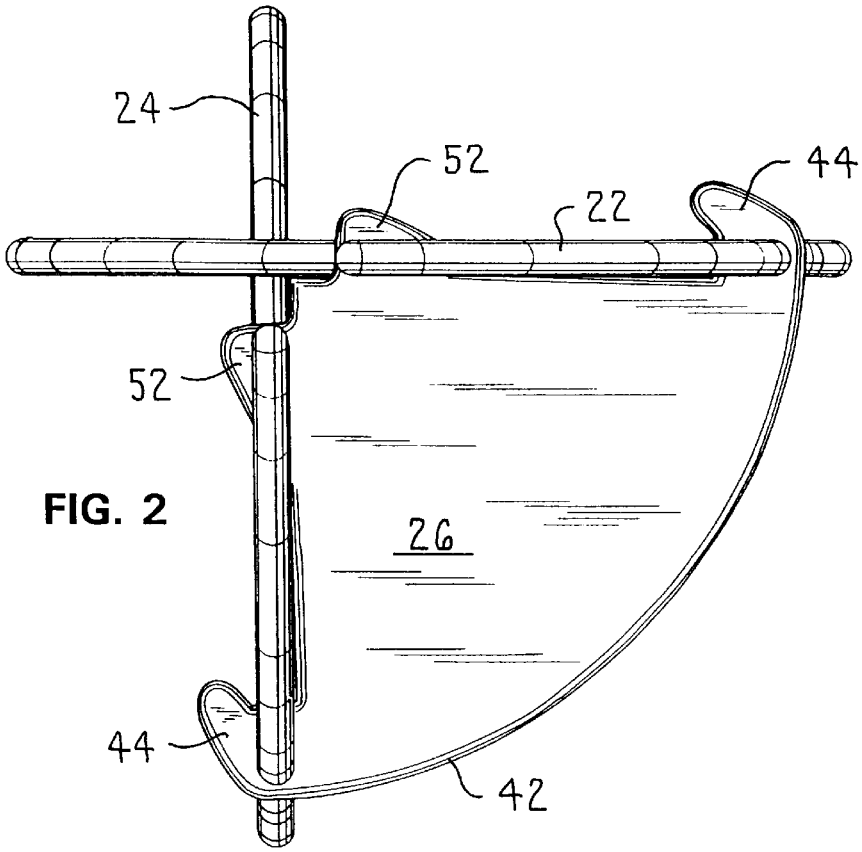
FIG. 2 is a top view of the chair of our design.
Figure 3:
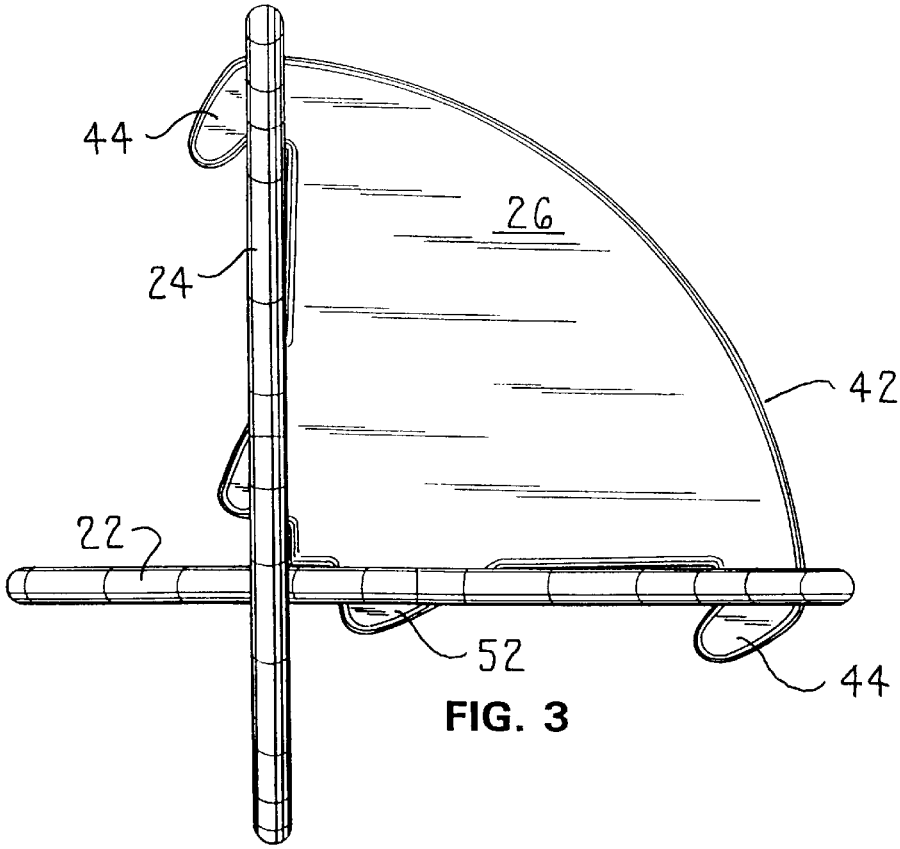
FIG. 3 is a bottom view of the chair of our design.
Figure 4:
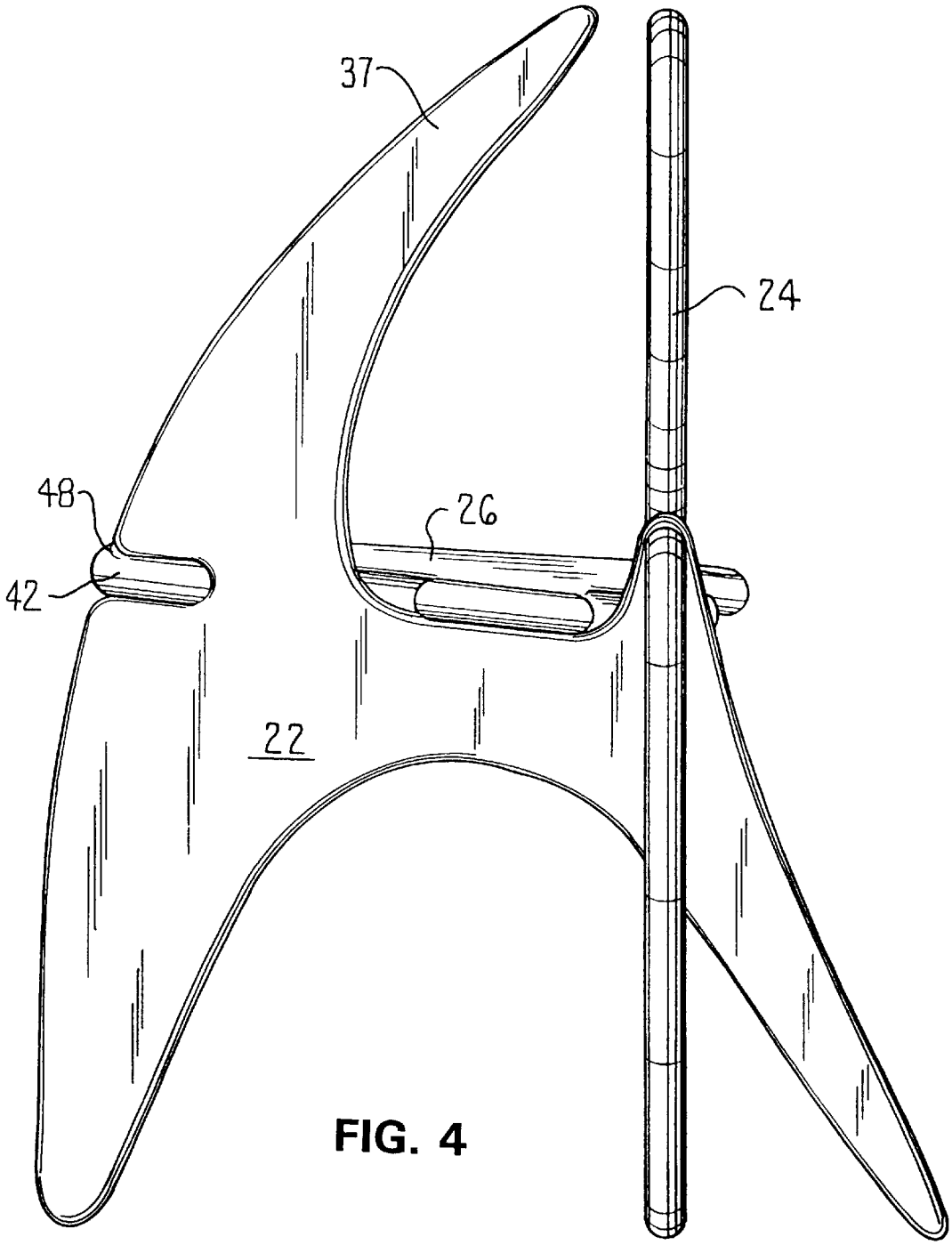
FIG. 4 is a back view of the chair of our design when viewing the back of the vertical panel depicting in the background in FIG. 1.
Figure 5:
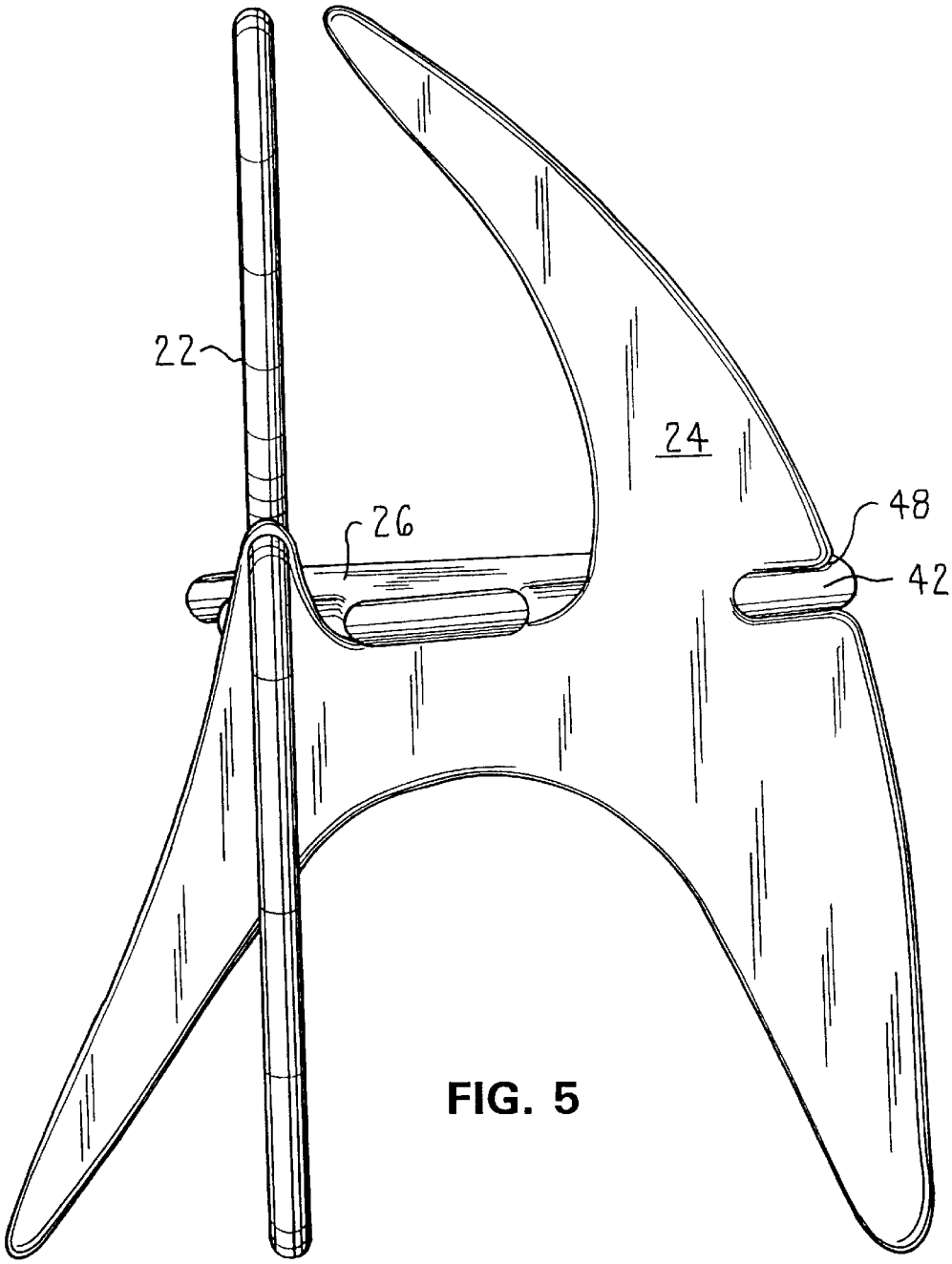
FIG. 5 is a back view of the chair of our design when viewing the back of the vertical panel depicted in the foregoing of FIG. 1.
Figure 6:
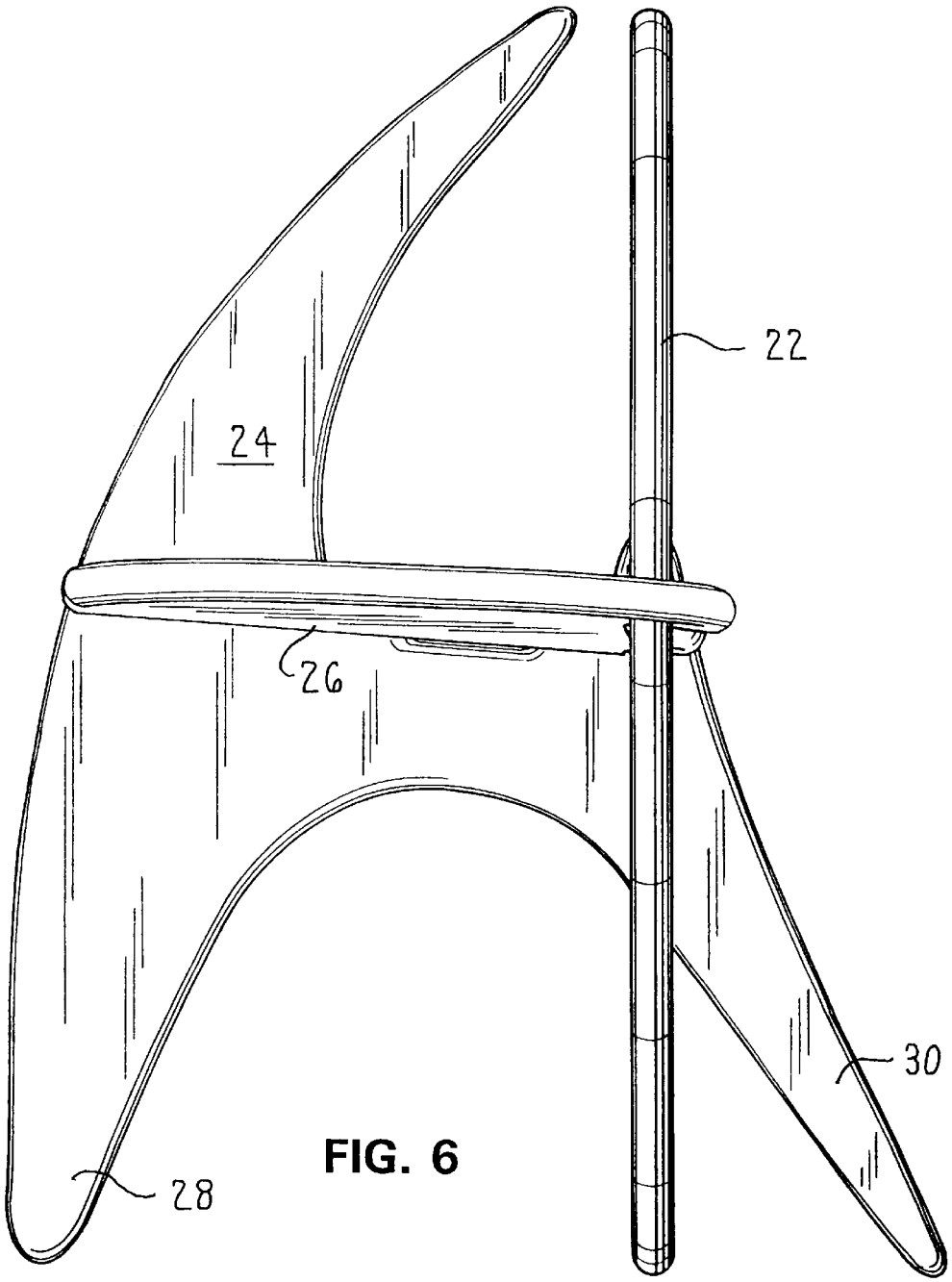
FIG. 6 is an upwardly directed perspective view of the chair of our design when viewing the vertical side panel depicted in the foreground in FIG. 1 from a straight-on perspective, the vertical side panel depicted in the background in FIG. 1 now being depicted in front of the other panel and being directed out of the page.
Figure 7:
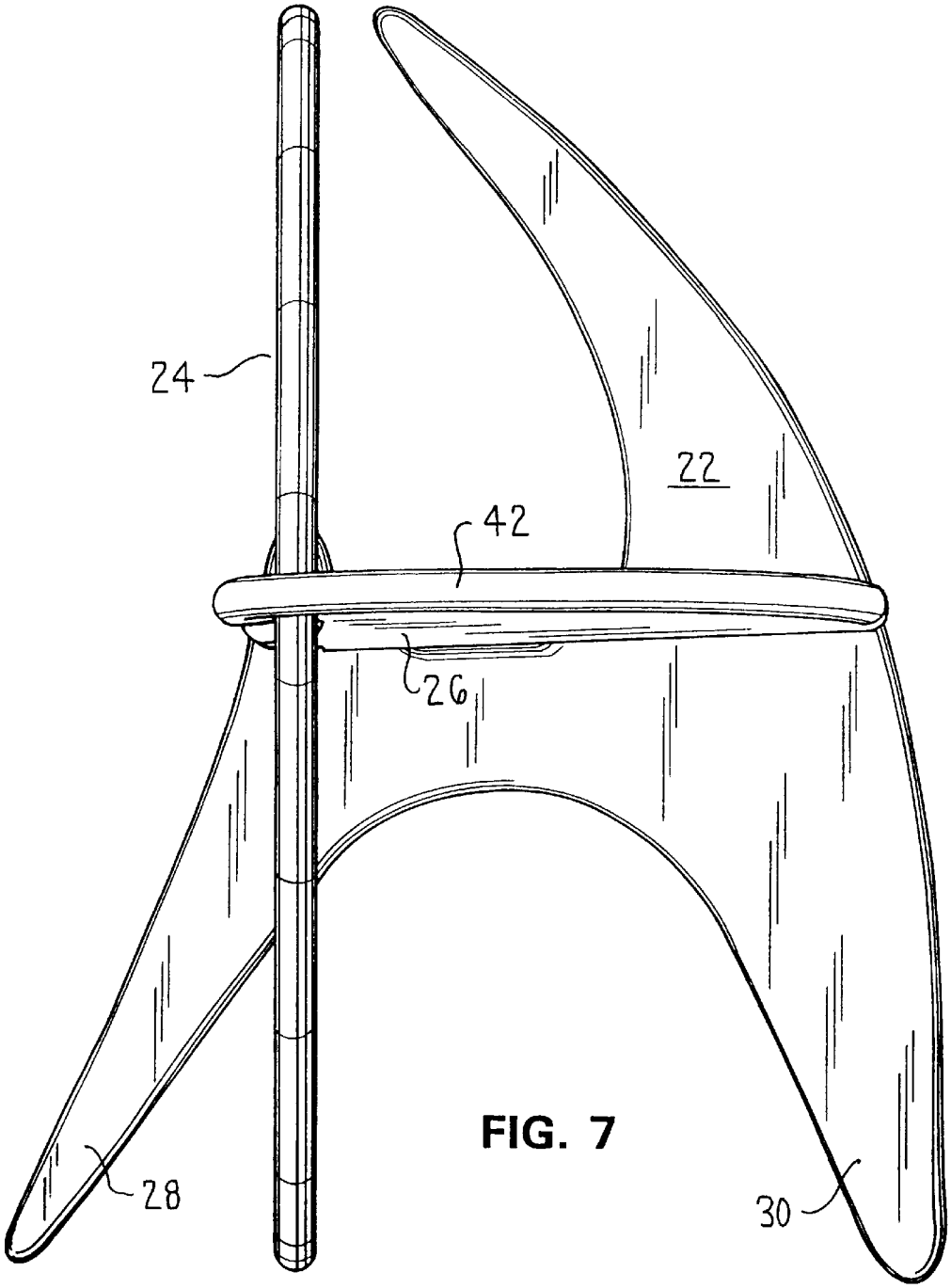
FIG. 7 is an upwardly directed perspective view of the chair of our design when viewing the vertical side panel depicted in the background in FIG. 1 from a straight-on perspective, the vertical side panel depicted in the foregoing in FIG. 1 now being depicted in front of the other panel and being directed out of the page.
Figure 8:
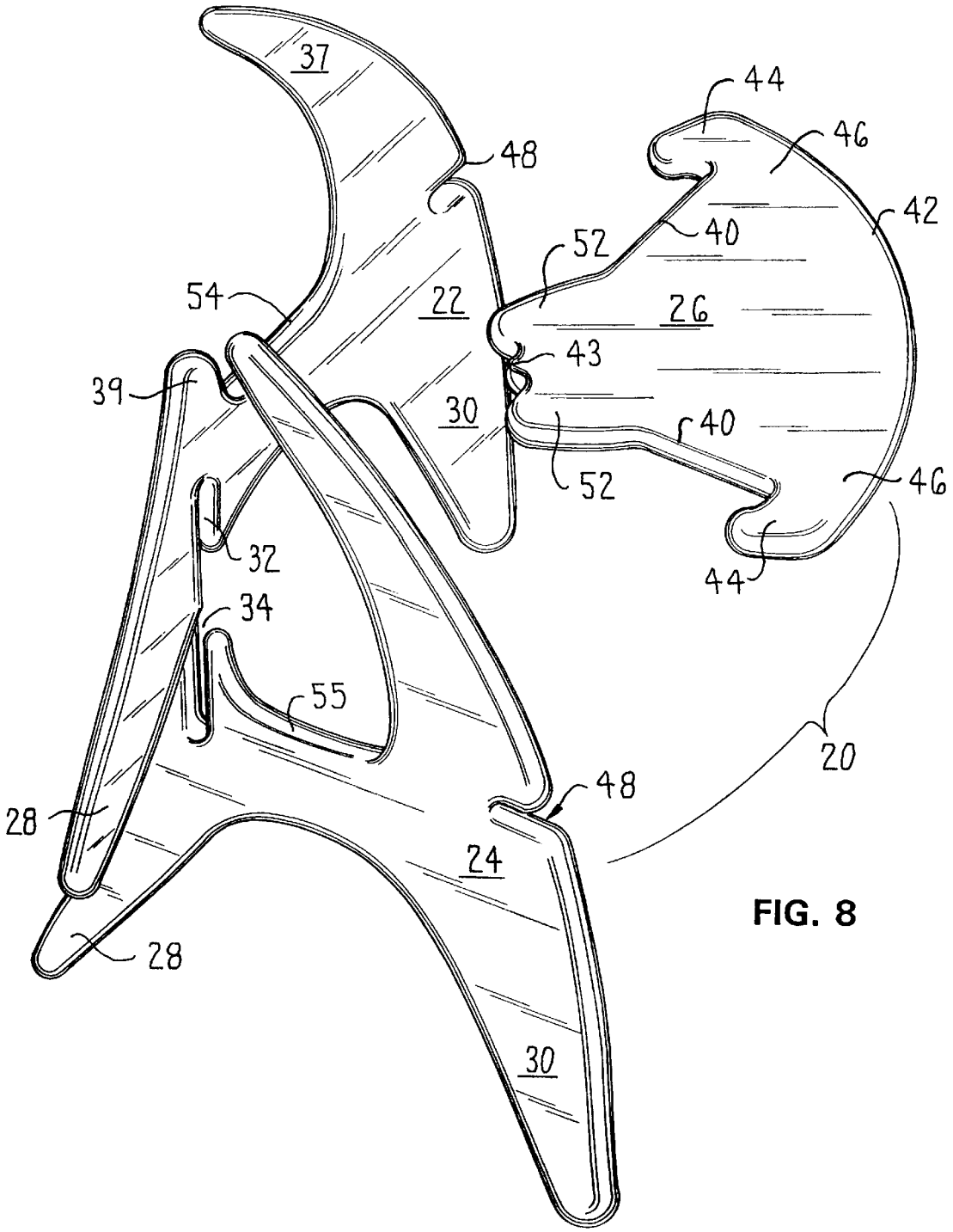
FIG. 8 is an exploded view illustrating how the two vertical panels and horizontal panel are assembled to construct the chair of this design.

A chair 20 of this invention depicted in FIGS. 1–8, includes a right side panel 22, a left side panel 24 and a seat panel 26. The panels 22–26 may be formed from wood, wood composites, plastic or any suitable materials. The right and left side panels 22 and 24, respectively support the seat panel 26. Each side panel 22 and 24 has a lower section that is formed to have a rear leg 28 and a front leg 30 spaced from the rear leg. The right side panel 22 is formed with an upwardly directly slot 32 between its legs 28 and 30. The left side panel 24 is formed with a downwardly directed slot 34 between its legs 28 and 30. The upwardly and downwardly directed slots 32 and 34, respectively, of the right and left side panels cooperate with each other to allow the side panels 22 and 24 to be locked together. More specifically, the portion of the right side panel above the downwardly directed slot 30 seats in the upwardly directed slot 32 and the portion of the left side panel 24 below the upwardly directed slot seats in the downwardly directed slot 30 so that the side panels lock together.

Each side panel 22 and 24 is further formed to have a back section that is located above the legs 28 and 30. In the depicted version of the invention, each back section includes a front portion 37 that extends upwardly from the associated panel front leg 30 and a rear portion 39, spaced from the front portion, that extends upwardly from he associated panel rear leg 28.

The seat panel 26 is shaped to have two side edges 40 that meet at a corner 43 defined by the intersection of the side panels 22 and 24 and that extend towards the front of the chair. The seat panel 26 further has a front edge 42 that extends between the side edges 44. The seat panel 26 is formed to have wings 44 which extend outwardly from the side edges of the panel adjacent the front edge. Each wing 44 is formed with a reduced-width shoulder section 46 that seats in a separate slot 48 formed in the front of one of the side panels 22 or 24. Each wing 44 is further shaped to extend rearwardly from the associated shoulder section so as to restrict movement of the complementary side panel 22 or 24 with which it is mated. The seat panel 26 is further formed to have support tabs 52 which extend outwardly from the side edges adjacent the point where the side edges come together. A first support tab 52 rests on a complementary support surface 54 formed by the right side panel 22; the second support tab 52 rests on a complementary support surface 55 formed by the left side panel 24. Each side panel is formed so that its support surface is spaced rearward from its slot and the front portion of the panel backs 51. The wings 48 and the support tabs 52 hold the seat panel 26 to the side panels 22 and 24.

In the depicted version of the invention, the side panels 22 and 24 meet at a 90° angle. The side panels 22 and 24 are formed to hold the seat section 26 horizontal to the ground surface.

This chair 20 is thus formed out of three planar panels. The panels 22–26 themselves may be of unitary construction and not formed from individual pieces. The panels are assembled together without the use of supplemental fasteners. The assembly of the chair does not require the use of any fastening tools.

We claim:

1. A chair, said chair including:

right and left side panels, each said side panel being formed to define: at least one leg; a back section located above said at least one leg, said back section having a front portion; a seat slot that extends rearwardly from a front edge of said side panel; and a seat support surface that is located rearward of the front portion of said back section wherein at least a first one of said side panels is formed with a panel slot and a second one of said side panels is seated in the panel slot; and a seat panel located between said side panels, said seat panel having: side edges that extend outwardly from a common corner, and a front edge that extends between ends of the side edges distal from the common corner; a pair of opposed wings, each said wing extending outwardly from one side edge adjacent the front edge and extending through the seat slot formed in an adjacent said side panel; and a pair of opposed tabs, each said tab extending outwardly from one side edge adjacent the corner and being disposed over the seat support surface of the adjacent said side panel.

2. The chair of claim 1, wherein both said side panels are formed with panel slots and said side panels interlock by seating each said side panel in the panel slot of the other said side panel.

3. The chair of claim 1, wherein each said side panel is formed to have a rear leg and a front leg spaced apart from said rear leg.

4. The chair of claim 3, wherein each said side panel is formed so that the front portion of said back section extends upwardly from said front leg, said back section has a rear portion that extends upwardly from the rear leg and the seat support surface is located between the front and the rear portions of said back section.

5. The chair of claim 1, wherein each said side panel is formed so that said back section has a rear portion spaced from the front portion and the seat support surface is located between the front and the rear portions of said back section.

6. The chair of claim 1, wherein said side panels are further formed to hold said seat panel in a horizontal orientation.

7. The chair of claim 1, wherein said side panels intersect at 90°.

8. A chair, said chair including:

a seat section, said seat section formed to define: a front edge; two side edges that extend rearwardly from the front edge and that meet at a corner; two opposed wings, each said wing extending outwardly from a separate one of the side edges adjacent the front edge; and two opposed tabs, each said tab extending outwardly from a separate one of said side edges adjacent the corner; and two opposed side panels, each said side panel being located adjacent a separate one of the side edges of said seat section, each said side panel having: at least one leg, a seat slot located above said leg and a seat support surface located rearwardly of the seat slot, wherein said side panels interlock with each other, said seat section wings are fitted in the seat slots and said seat section tabs seat on the seat support surfaces.

9. The chair of claim 8, wherein both said side panels are formed with panel slots and said side panels interlock by seating each said side panel in the panel slot of the other said side panel.

10. The chair of claim 8, wherein each said side panel is formed to have a rear leg and a front leg spaced apart from said rear leg.

11. The chair of claim 10, wherein each said side panel is formed to have a back section that has a front portion that extends upwardly from said front leg, a rear portion that extends upwardly from the rear leg and said seat support surface is located between the front and the rear portions of said back section.

12. The chair of claim 8, wherein each said side section is formed to have a back section that extends above said seat section.

13. The chair of claim 12, wherein each said side panel is formed so that the back section has a front portion and a rear portion spaced from said front portion and seat support surface is located between the front and the rear portions of said back section.

14. The chair of claim 8, wherein said side panels are further formed to hold said seat section in a horizontal orientation.

15. The chair of claim 8, wherein said side panels intersect at 90°.

16. The chair of claim 8, wherein a first one of said side panels is formed with a panel slot and a second one of said side panels is seated in the panel slot.

* * * * *

UNITED STATES PATENT AND TRADEMARK OFFICE

CERTIFICATE OF CORRECTION

PATENT NO. : 6,247,754 B1
DATED : June 19, 2001
INVENTOR(S) : Daniel A. Vanderaue et al.

It is certified that error appears in the above-identified patent and that said Letters Patent is hereby corrected as shown below:

Column 4,
Line 23, change "said side section" to -- said side panel --.

Signed and Sealed this

Twenty-sixth Day of February, 2002

*Attest:*

*Attesting Officer*

JAMES E. ROGAN
*Director of the United States Patent and Trademark Office*